US009617793B2

(12) United States Patent
Scott et al.

(10) Patent No.: US 9,617,793 B2
(45) **Date of Patent: *Apr. 11, 2017**

(54) POLYCRYSTALLINE COMPACTS INCLUDING DIFFERING REGIONS, AND RELATED EARTH-BORING TOOLS AND METHODS OF FORMING CUTTING ELEMENTS

(71) Applicant: Baker Hughes Incorporated, Houston, TX (US)

(72) Inventors: Danny E. Scott, Montgomery, TX (US); Anthony A. DiGiovanni, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 274 days.

This patent is subject to a terminal disclaimer.

(21) Appl. No.: 14/282,740

(22) Filed: May 20, 2014

(65) Prior Publication Data

US 2014/0251698 A1 Sep. 11, 2014

Related U.S. Application Data

(63) Continuation of application No. 13/162,864, filed on Jun. 17, 2011, now Pat. No. 8,763,731, which is a (Continued)

(51) Int. Cl.
*E21B 10/567* (2006.01)
*E21B 10/55* (2006.01)

(Continued)

(52) U.S. Cl.
CPC ..... *E21B 10/55* (2013.01); *B22F 3/14* (2013.01); *B22F 7/02* (2013.01); *B22F 7/062* (2013.01);

(Continued)

(58) Field of Classification Search
CPC .. E21B 2010/561; E21B 10/567; E21B 10/55; E21B 10/46; E21B 2010/545; C22C 23/00; C22C 2026/008; B24D 3/10
See application file for complete search history.

(56) References Cited

U.S. PATENT DOCUMENTS 4,224,380 A 9/1980 Bovenkerk et al.
5,127,923 A 7/1992 Bunting et al.

(Continued)

FOREIGN PATENT DOCUMENTS

CN 86104661 A 12/1986
EP 1760165 A2 3/2007
WO 2008063568 A1 5/2008

OTHER PUBLICATIONS

European Search Report for European Application No. 12736595.5 dated Jun. 2, 2014, 6 pages.

(Continued)

*Primary Examiner* — Nicole Coy
(74) *Attorney, Agent, or Firm* — TraskBritt

(57) ABSTRACT

Polycrystalline compacts include a hard polycrystalline material comprising first and second regions. The first region comprises a first plurality of grains of hard material having a first average grain size, and a second plurality of grains of hard material having a second average grain size smaller than the first average grain size. The first region comprises catalyst material disposed in interstitial spaces between inter-bonded grains of hard material. Such interstitial spaces between grains of the hard material in the second region are at least substantially free of catalyst material. In some embodiments, the first region comprises a plurality of nanograins of the hard material. Cutting elements and earth-boring tools include such polycrystalline compacts. Methods of forming such polycrystalline compacts include removing catalyst material from interstitial spaces within a second (Continued)

region of a polycrystalline compact without entirely removing catalyst material from interstitial spaces within a first region of the compact.

19 Claims, 7 Drawing Sheets

Related U.S. Application Data continuation-in-part of application No. 13/010,620, filed on Jan. 20, 2011, now abandoned.

(51) Int. Cl.

| | |
|---|---|
| ***B24D 3/10*** | (2006.01) |
| ***C22C 23/00*** | (2006.01) |
| ***B22F 3/14*** | (2006.01) |
| ***B22F 7/02*** | (2006.01) |
| ***B22F 7/06*** | (2006.01) |
| *E21B 10/56* | (2006.01) |
| *E21B 10/54* | (2006.01) |
| *C22C 26/00* | (2006.01) |

(52) U.S. Cl.

CPC ..... *B24D 3/10* (2013.01); *C22C 23/00* (2013.01); *C22C 26/00* (2013.01); *E21B 10/567* (2013.01); *C22C 2026/008* (2013.01); *E21B 2010/545* (2013.01); *E21B 2010/561* (2013.01); *Y10T 428/249957* (2015.04); *Y10T 428/25* (2015.01)

(56) References Cited

U.S. PATENT DOCUMENTS

| | | | | |
|---|---|---|---|---|
| 5,954,147 | A | 9/1999 | Overstreet et al. | |
| 2008/0206576 | A1 | 8/2008 | Qian et al. | |
| 2009/0095538 | A1 | 4/2009 | Middlemiss | |
| 2009/0152015 | A1 | 6/2009 | Sani et al. | |
| 2010/0186304 | A1 | 7/2010 | Burgess et al. | |
| 2010/0225311 | A1 | 9/2010 | Bertagnolli et al. | |
| 2010/0294571 | A1 | 11/2010 | Belnap et al. | |
| 2010/0320006 | A1 | 12/2010 | Fan et al. | |
| 2011/0036643 | A1* | 2/2011 | Belnap | C22C 26/00 175/434 |
| 2012/0186884 | A1 | 7/2012 | Scott et al. | |
| 2012/0186885 | A1 | 7/2012 | Scott et al. | |

OTHER PUBLICATIONS

Underwood, Ervin E., Quantitative Stereology, Addison-Wesley Publishing Company, Inc., 1970, 20 pages.

International Search Report for International Application No. PCT/US2012/020182 dated Aug. 9, 2012, 3 pages.

International Written Opinion for International Application No. PCT/US2012/020182 dated Aug. 9, 2012, 5 pages.

International Preliminary Report on Patentability for International Application No. PCT/US2012/020182 dated Jul. 23, 2013, 6 pages.

Chinese Office Action and Search Report for Chinese Application No. 201280010698.4 dated Oct. 20, 2014, 21 pages.

* cited by examiner

POLYCRYSTALLINE COMPACTS INCLUDING DIFFERING REGIONS, AND RELATED EARTH-BORING TOOLS AND METHODS OF FORMING CUTTING ELEMENTS

CROSS-REFERENCE TO RELATED APPLICATIONS

This application is a continuation of U.S. patent application Ser. No. 13/162,864, filed Jun. 17, 2011, now U.S. Pat. No. 8,763,731, issued Jul. 1, 2014, which is a continuation-in-part of U.S. patent application Ser. No. 13/010,620, filed Jan. 20, 2011, abandoned, the disclosure of each of which is hereby incorporated herein in its entirety by this reference.

FIELD

The present invention relates generally to polycrystalline compacts, which may be used, for example, as cutting elements for earth-boring tools, and to methods of forming such polycrystalline compacts, cutting elements, and earth-boring tools.

BACKGROUND

Earth-boring tools for forming wellbores in subterranean earth formations generally include a plurality of cutting elements secured to a body. For example, fixed-cutter earth-boring rotary drill bits (also referred to as "drag bits") include a plurality of cutting elements that are fixedly attached to a bit body of the drill bit. Similarly, roller cone earth-boring rotary drill bits may include cones that are mounted on bearing pins extending from legs of a bit body such that each cone is capable of rotating about the bearing pin on which it is mounted. A plurality of cutting elements may be mounted to each cone of the drill bit. In other words, earth-boring tools typically include a bit body to which cutting elements are attached.

The cutting elements used in such earth-boring tools often include polycrystalline diamond compacts (often referred to as "PDC"), one or more surfaces of which may act as cutting faces of the cutting elements. Polycrystalline diamond material is material that includes inter-bonded grains or crystals of diamond material. In other words, polycrystalline diamond material includes direct, inter-granular bonds between the grains or crystals of diamond material. The terms "grain" and "crystal" are used synonymously and interchangeably herein.

Polycrystalline diamond compact cutting elements are typically formed by sintering and bonding together relatively small diamond grains under conditions of high temperature and high pressure in the presence of a catalyst (e.g., cobalt, iron, nickel, or alloys and mixtures thereof) to form a layer (e.g., a compact or "table") of polycrystalline diamond material on a cutting element substrate. These processes are often referred to as high temperature/high pressure (HTHP) processes. The cutting element substrate may comprise a cermet material (i.e., a ceramic-metal composite material) such as, for example, cobalt-cemented tungsten carbide. In such instances, the cobalt (or other catalyst material) in the cutting element substrate may be swept into the diamond grains during sintering and serve as the catalyst material for forming the inter-granular diamond-to-diamond bonds, and the resulting diamond table, from the diamond grains. In other methods, powdered catalyst material may be mixed with the diamond grains prior to sintering the grains together in a HTHP process.

Upon formation of a diamond table using a HTHP process, catalyst material may remain in interstitial spaces between the grains of diamond in the resulting polycrystalline diamond compact. The presence of the catalyst material in the diamond table may contribute to thermal damage in the diamond table when the cutting element is heated during use, due to friction at the contact point between the cutting element and the formation.

Polycrystalline diamond compact cutting elements in which the catalyst material remains in the polycrystalline diamond compact are generally thermally stable up to a temperature of about seven hundred fifty degrees Celsius (750° C.), although internal stress within the cutting element may begin to develop at temperatures exceeding about three hundred fifty degrees Celsius (350° C.). This internal stress is at least partially due to differences in the rates of thermal expansion between the diamond table and the cutting element substrate to which it is bonded. This differential in thermal expansion rates may result in relatively large compressive and tensile stresses at the interface between the diamond table and the substrate, and may cause the diamond table to delaminate from the substrate. At temperatures of about seven hundred fifty degrees Celsius (750° C.) and above, stresses within the diamond table itself may increase significantly due to differences in the coefficients of thermal expansion of the diamond material and the catalyst material within the diamond table. For example, cobalt thermally expands significantly faster than diamond, which may cause cracks to form and propagate within the diamond table, eventually leading to deterioration of the diamond table and ineffectiveness of the cutting element.

Furthermore, at temperatures at or above about seven hundred fifty degrees Celsius (750° C.), some of the diamond crystals within the polycrystalline diamond compact may react with the catalyst material causing the diamond crystals to undergo a chemical breakdown or back-conversion to another allotrope of carbon or another carbon-based material. For example, the diamond crystals may graphitize at the diamond crystal boundaries, which may substantially weaken the diamond table. In addition, at extremely high temperatures, in addition to graphite, some of the diamond crystals may be converted to carbon monoxide and carbon dioxide.

In order to reduce the problems associated with differential rates of thermal expansion and chemical breakdown of the diamond crystals in polycrystalline diamond compact cutting elements, so-called "thermally stable" polycrystalline diamond compacts (which are also known as thermally stable products, or "TSPS") have been developed. Such a thermally stable polycrystalline diamond compact may be formed by leaching the catalyst material (e.g., cobalt) out from interstitial spaces between the inter-bonded diamond crystals in the diamond table using, for example, an acid or combination of acids (e.g., aqua regia). All of the catalyst material may be removed from the diamond table, or catalyst material may be removed from only a portion thereof. Thermally stable polycrystalline diamond compacts in which substantially all catalyst material has been leached out from the diamond table have been reported to be thermally stable up to temperatures of about twelve hundred degrees Celsius (1,200° C.). It has also been reported, however, that such fully leached diamond tables are relatively more brittle and vulnerable to shear, compressive, and tensile stresses than are non-leached diamond tables. In addition, it is difficult to secure a completely leached diamond table to a supporting substrate. In an effort to provide cutting elements having polycrystalline diamond compacts that are more thermally stable relative to non-leached polycrystalline diamond compacts, but that are also relatively less brittle and vulnerable to shear, compressive, and tensile stresses relative to fully leached diamond tables, cutting elements have been provided that include a diamond table in which the catalyst material has been leached from a portion or portions of the diamond table. For example, it is known to leach catalyst material from the cutting face, from the side of the diamond table, or both, to a desired depth within the diamond table, but without leaching all of the catalyst material out from the diamond table.

BRIEF SUMMARY

In some embodiments, the present invention includes polycrystalline compacts that comprise a hard polycrystalline material including a first region and a second region. The first region comprises a first plurality of grains of hard material having a first average grain size, and a second plurality of grains of hard material having a second average grain size, smaller than the first average grain size. The grains of the first plurality of grains of hard material and of the second plurality of grains of hard material are interspersed and inter-bonded. The first region further comprises catalyst material for catalyzing the formation of inter-granular bonds between the grains of the first plurality of grains of hard material and of the second plurality of grains of hard material. The catalyst material is disposed in interstitial spaces between the inter-bonded grains of hard material of the first plurality of grains of hard material and of the second plurality of grains of hard material. The second region is disposed adjacent and directly bonded to the first region along an interface between the first region and the second region. The second region comprises a third plurality of grains of hard material having a third average grain size. The grains of the third plurality of grains of hard material are interspersed and inter-bonded. Interstitial spaces between the inter-bonded grains of the third plurality of grains of hard material are at least substantially free of catalyst material for catalyzing the formation of inter-granular bonds between the grains of the third plurality of grains of hard material.

In additional embodiments, the present invention includes polycrystalline compacts that comprise a volume of polycrystalline diamond including a first region and a leached second region. The first region comprises a first plurality of diamond grains and a second plurality of diamond grains. The second plurality of diamond grains have an average grain size of about five hundred nanometers (500 nm) or less, and are disposed and interspersed between the grains of the first plurality of diamond grains. The first plurality of diamond grains and the second plurality of diamond grains are interspersed and inter-bonded. The first region further includes a catalyst material for catalyzing the formation of inter-granular diamond bonds. The catalyst material is disposed in interstitial spaces between the inter-bonded grains of the first plurality of diamond grains and the second plurality of diamond grains. The leached second region is disposed adjacent and directly bonded to the first region, and also comprises inter-bonded diamond grains. The inter-bonded diamond grains of the leached second region comprise between about eighty percent (80%) and about ninety-two percent (92%) of a volume of the leached second region, and voids in interstitial spaces between the inter-bonded diamond grains of the leached second region at least substantially comprise a remainder of the volume of the leached second region.

Further embodiments of the invention include cutting elements that include a cutting element substrate, and such a polycrystalline compact bonded to the cutting element substrate. Yet further embodiments of the invention include earth-boring tools comprising a tool body, and at least one cutting element comprising such a polycrystalline compact attached to the tool body.

In additional embodiments, the present invention includes methods of forming a polycrystalline compact. In accordance with such methods, an unsintered compact preform is formed by mixing a first plurality of grains of hard material having a first average grain size with a second plurality of grains of hard material having a second average grain size smaller than the first average grain size to form a first particulate mixture, and positioning a third plurality of grains of hard material having a third average grain size adjacent the first particulate mixture within a container. The compact preform then may be sintered at a pressure greater than about five gigapascals (5.0 GPa) and a temperature greater than about 1,300° C. in the presence of a catalyst material for catalyzing the formation of inter-granular bonds between the grains of hard material of the first plurality of grains of hard material, the second plurality of grains of hard material, and the third plurality of grains of hard material. Sintering the unsintered compact preform comprises forming a hard polycrystalline material having a first region comprising inter-bonded grains of the first plurality of grains of hard material and the second plurality of grains of hard material, and a second region comprising inter-bonded grains of the third plurality of grains of hard material. Catalyst material then may be removed from interstitial spaces within the second region of the hard polycrystalline material without entirely removing catalyst material from interstitial spaces within the first region of the hard polycrystalline material.

BRIEF DESCRIPTION OF THE DRAWINGS

While the specification concludes with claims particularly pointing out and distinctly claiming what are regarded as embodiments of the present invention, various features and advantages of embodiments of the invention may be more readily ascertained from the following description of some embodiments of the invention when read in conjunction with the accompanying drawings, in which:

DETAILED DESCRIPTION

The illustrations presented herein are not actual views of any particular polycrystalline compact, microstructure of polycrystalline material, particles, or drill bit, and are not drawn to scale, but are merely idealized representations, which are employed to describe the present invention. Additionally, elements common between figures may retain the same numerical designation.

As used herein, the term "nanoparticle" means and includes any particle having an average particle diameter of about five hundred nanometers (500 nm) or less.

The term "polycrystalline material" means and includes any material comprising a plurality of grains (i.e., crystals) of the material that are bonded directly together by inter-granular bonds. The crystal structures of the individual grains of the material may be randomly oriented in space within the polycrystalline material.

As used herein, the term "inter-granular bond" means and includes any direct atomic bond (e.g., covalent, metallic, etc.) between atoms in adjacent grains of material.

Figure 1:
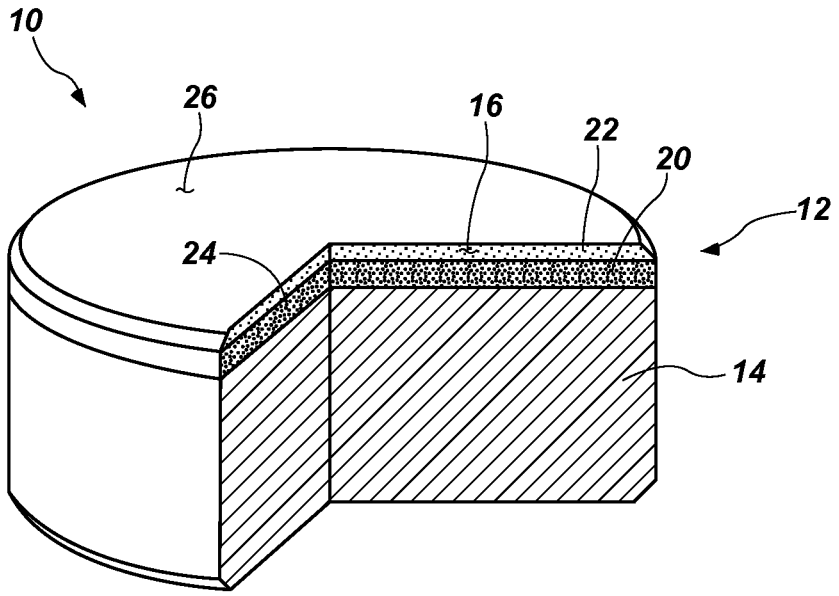
FIG. 1 is a partial cut-away perspective view illustrating an embodiment of a cutting element comprising a polycrystalline compact of the present invention, which includes two regions having differing diamond densities and catalyst content therein.

FIG. 1 is a simplified drawing illustrating an embodiment of a cutting element 10 that includes a polycrystalline compact 12 that is bonded to a cutting element substrate 14. The polycrystalline compact 12 comprises a table or layer of hard polycrystalline material 16 that has been provided on (e.g., formed on or secured to) a surface of a supporting cutting element substrate 14.

In some embodiments, the hard polycrystalline material 16 comprises polycrystalline diamond. In other embodiments, the hard polycrystalline material 16 may comprise polycrystalline cubic boron nitride. The cutting element substrate 14 may comprise a cermet material such as cobalt-cemented tungsten carbide.

Figure 2:
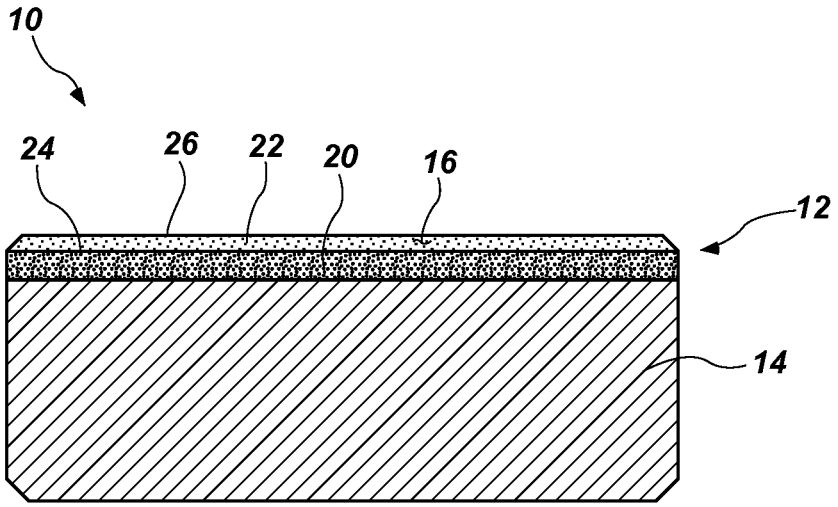
FIG. 2 is a cross-sectional side view of the cutting element shown in FIG. 1.

The polycrystalline compact 12 includes a plurality of regions having differing densities of the hard polycrystalline material 16 and different contents of catalyst material, as discussed in further detail below. By way of non-limiting example, the polycrystalline compact 12 may include a first region 20 and a second region 22, as shown in FIGS. 1 and 2. The second region 22 may be disposed adjacent the first region 20, and may be directly bonded to the first region 20 along an interface 24 therebetween. As discussed in further detail below, the interface 24 may be employed to define a boundary between a leached region and an unleached region within the hard polycrystalline material 16. The first region 20 may comprise an unleached region, and the second region 22 may comprise a leached region. The first region 20 and the second region 22 may be sized and configured such that the hard polycrystalline material 16 exhibits desirable physical properties, such as wear-resistance, fracture toughness, and thermal stability, when the cutting element 10 is used to cut formation material. For example, the first region 20 and the second region 22 may be selectively sized and configured to enhance (e.g., optimize) one or more of a wear-resistance, a fracture toughness, and a thermal stability, of the hard polycrystalline material 16 when the cutting element 10 is used to cut formation material.

Figure 3:
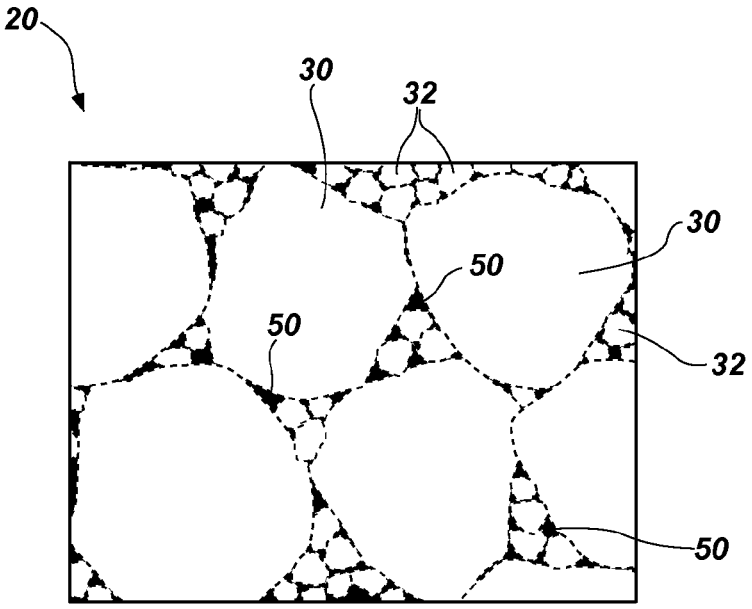
FIG. 3 is a simplified drawing showing how a microstructure of a first region of the polycrystalline compact of FIGS. 1 and 2 may appear under magnification, and illustrates inter-bonded and interspersed larger and smaller grains of hard material with catalyst material in interstitial spaces between the inter-bonded grains of hard material.
Figure 4:
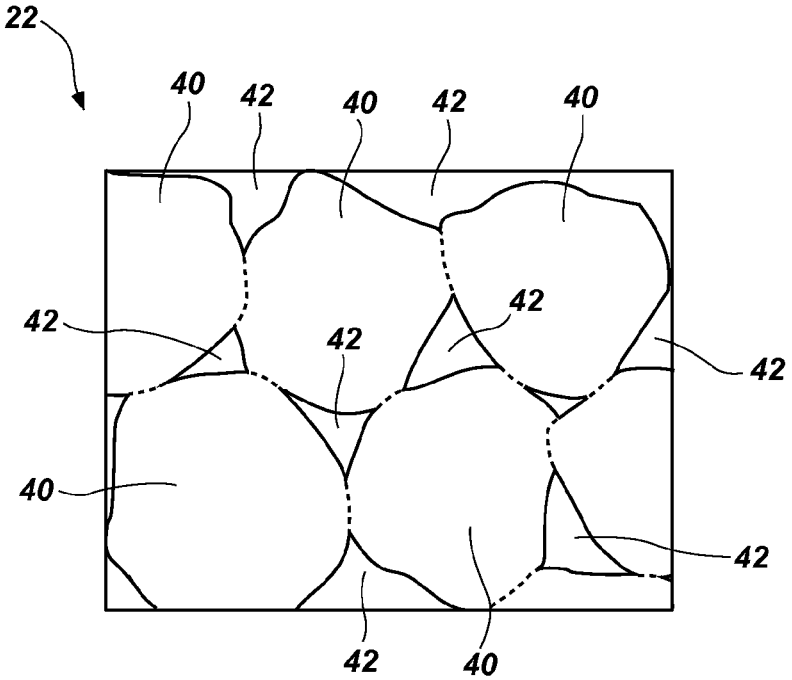
FIG. 4 is a simplified drawing showing how a microstructure of a second region of the polycrystalline compact of FIGS. 1 and 2 may appear under magnification, and illustrates inter-bonded and interspersed grains of hard material with no catalyst material in interstitial spaces between the inter-bonded grains of hard material.

FIG. 3 is a simplified, enlarged view illustrating how a microstructure of the hard polycrystalline material 16 in the first region 20 of the polycrystalline compact 12 may appear under magnification, and FIG. 4 is a simplified, enlarged view illustrating how a microstructure of the hard polycrystalline material 16 in the second region 22 of the polycrystalline compact 12 may appear at the same level of magnification. The polycrystalline compact 12 may be fabricated such that the microstructures within the first region 20 and the second region 22 are different in one or more characteristics that facilitate removal of a catalyst material from within the second region 22 without removing any significant portion of catalyst material from within the first region 20, as discussed in further detail below. For example, the interstitial spaces between inter-bonded grains of hard material within the first region 20 may be smaller and more dispersed relative to interstitial spaces between inter-bonded grains of hard material within the second region 22, and/or the interstitial spaces between inter-bonded grains of hard material within the first region 20 may comprise a smaller volume percentage of the first region 20 relative to a volume percentage of the second region 22 occupied by the interstitial spaces between inter-bonded grains of hard material within the second region 20. Further, the density of hard polycrystalline material 16 within the first region 20 may be higher than a density of the hard polycrystalline material 16 within the second region 22. The density of the hard polycrystalline material 16 may be rendered higher in the first region 20 by, for example, incorporating nanoparticles or nanograins of the hard polycrystalline material 16 into interstitial spaces between larger grains of the hard polycrystalline material 16 within the first region 20, but not within the second region 22.

The configurations of the polycrystalline compact 12 mentioned above and described in further detail below may allow a leaching fluid (e.g., a liquid acid) used to leach catalyst material out from the hard polycrystalline material 16 to flow more easily into and through the interstitial spaces within the second region 22 relative to the first region 20. As a result, catalyst material may be removed from the second region 22 without significantly removing catalyst material from the first region 20.

Referring to FIG. 3, the first region 20 of the polycrystalline compact 12 comprises a plurality of interspersed and inter-bonded grains of the hard polycrystalline material 16.

These inter-bonded grains of the hard polycrystalline material 16 have a multi-modal (e.g., bi-modal, tri-modal, etc.) grain size distribution. For example, the hard polycrystalline material 16 may include a first plurality of grains 30 of hard material having a first average grain size, and at least a second plurality of grains 32 of hard material having a second average grain size that differs from the first average grain size of the first plurality of grains 30, as shown in FIG. 3. The second plurality of grains 32 may be smaller than the first plurality of grains 30. While FIG. 3 illustrates the second plurality of grains 32 as being smaller, on average, than the first plurality of grains 30, the drawings are not to scale and have been simplified for purposes of illustration. In some embodiments, the difference between the average sizes of the first plurality of grains 30 and the second plurality of grains 32 may be greater than or less than the difference in the average grain sizes illustrated in FIG. 3. In some embodiments, the second plurality of grains 32 may comprise nanograins having an average grain size of about five hundred nanometers (500 nm) or less.

The larger plurality of grains 30 and the smaller plurality of grains 32 may be interspersed and inter-bonded to form the hard polycrystalline material 16. In other words, in embodiments in which the hard polycrystalline material 16 comprises polycrystalline diamond, the larger plurality of grains 30 and the smaller plurality grains 32 may be mixed together and bonded directly to one another by inter-granular diamond-to-diamond bonds.

Referring to FIG. 4, the second region 22 of the polycrystalline compact 12 comprises a third plurality of grains 40 of the hard polycrystalline material 16 having a third average grain size, which grains 40 are also interspersed and inter-bonded with one another. As shown in FIG. 4, in some embodiments, the grains 40 of hard polycrystalline material 16 within the second region 22 may have a mono-modal grain size distribution. In other embodiments, however, the inter-bonded grains 40 of the hard polycrystalline material 16 in the second region 22 may have a multi-modal (e.g., bi-modal, tri-modal, etc.) grain size distribution. In such embodiments, however, the average grain size of each mode may be greater than about five hundred nanometers (500 nm). In other words, the second region 22 may be substantially free of nanoparticles or nanograins of the hard polycrystalline material 16.

With combined reference to FIGS. 3 and 4, as non-limiting examples, each of the first average grain size of the first plurality of grains 30 and the third average grain size of the third plurality of grains 40 may be at least about five microns (5 μm), and the second average grain size of the second plurality of grains 32 may be about one micron (1 μm) or less. In some embodiments, the second average grain size of the second plurality of grains 32 may be about five hundred nanometers (500 nm) or less, about two hundred nanometers (200 nm) or less, or even about one hundred fifty nanometers (150 nm) or less. In some embodiments, each of the first average grain size of the first plurality of grains 30 and the third average grain size of the third plurality of grains 40 may be between about five microns (5 μm) and about forty microns (40 μm), and the second average grain size of the second plurality of grains 32 may be about five hundred nanometers (500 nm) or less (e.g., between about six nanometers (6 nm) and about one hundred fifty nanometers (150 nm)). In additional embodiments, each of the first average grain size of the first plurality of grains 30 and the third average grain size of the third plurality of grains 40 may be between about one micron (1 μm) and about five microns (5 μm), and the second average grain size of the second plurality of grains 32 may be about five hundred nanometers (500 nm) or less (e.g., between about six nanometers (6 nm) and about one hundred fifty nanometers (150 nm)).

In some embodiments, each of the first average grain size of the first plurality of grains 30 and the third average grain size of the third plurality of grains 40 may be at least about fifty (50) times greater, at least about one hundred (100) times greater, or even at least about one hundred fifty (150) times greater, than the second average grain size of the second plurality of grains 32.

The first plurality of grains 30 in the first region 20 of the hard polycrystalline material 16 and the third plurality of grains 32 in the second region 22 of the hard polycrystalline material 16 may have the same average grain size and grain size distribution. In additional embodiments, they may have different average grain sizes and/or grain size distributions.

As known in the art, the average grain size of grains within a microstructure may be determined by measuring grains of the microstructure under magnification. For example, a scanning electron microscope (SEM), a field emission scanning electron microscope (FESEM), or a transmission electron microscope (TEM) may be used to view or image a surface of a hard polycrystalline material 16 (e.g., a polished and etched surface of the hard polycrystalline material 16). Commercially available vision systems or image analysis software are often used with such microscopy tools, and these vision systems are capable of measuring the average grain size of grains within a microstructure.

The large difference in the average grain size between the larger grains 30 and the smaller grains 32 in the first region 20 of the hard polycrystalline material 16 may result in smaller interstitial spaces within the microstructure of the first region 20 of the hard polycrystalline material 16 (relative to within the second region 22 of the hard polycrystalline material 22), and the total volume of the interstitial spaces may be more evenly distributed throughout the microstructure of the hard polycrystalline material 16, and may be more finely dispersed within the microstructure of the hard polycrystalline material 16.

As mentioned above, the density of the hard polycrystalline material 16 may be higher in the first region 20 than in the second region 22. As non-limiting examples, the first plurality of grains 30 and the second plurality of grains 32 together may comprise between about ninety-two percent by volume (92 vol %) and about ninety-nine percent by volume (99 vol %) of the first region 20 of the hard polycrystalline material 16, and the third plurality of grains 40 may comprise between about eighty percent by volume (80 vol %) and about ninety-one percent by volume (91 vol %) of the second region 22 of the hard polycrystalline material 16. In some embodiments, the first plurality of grains 30 and the second plurality of grains 32 may together may comprise between about ninety-five percent by volume (95 vol %) and about ninety-nine percent by volume (99 vol %) of the first region 20 of the hard polycrystalline material 16, and the third plurality of grains 40 may comprise between about eighty-five percent by volume (85 vol %) and about eighty-eight percent by volume (88 vol %) of the second region 22 of the hard polycrystalline material 16.

As shown in FIG. 3, the first region 20 of the hard polycrystalline material 16 may further include catalyst material 50 (shaded black in FIG. 3) for catalyzing the formation of inter-granular bonds between the grains 30, 32 of the hard polycrystalline material 16. The catalyst material 50 is disposed in the interstitial spaces between the inter-bonded grains 30, 32 of the hard polycrystalline material 16 in the first region 20. As shown in FIG. 4, the interstitial spaces between the inter-bonded grains 40 of hard material in the second region 22 are at least substantially free of such catalyst material. The interstitial spaces between the grains 40 may comprise voids 42 filled with gas (e.g., air). In additional embodiments, the interstitial spaces between the grains 40 may be filled with another solid material that is not a catalyst material 50 and that will not contribute to degradation of the polycrystalline material 16 when the polycrystalline compact 12 is used to cut formation material in, for example, a drilling process.

The catalyst material 50 (FIG. 3) comprises a catalyst material capable of forming (and used to catalyze the formation of) inter-granular bonds between the grains 30, 32, 40 of the hard polycrystalline material 16. In embodiments in which the polycrystalline material 16 comprises polycrystalline diamond, the catalyst material 50 may comprise a Group VIIIA element (e.g., iron, cobalt, or nickel) or an alloy or mixture thereof. In additional embodiments, the catalyst material 50 may comprise a carbonate material such as, for example, a carbonate of one or more of Mg, Ca, Sr, and Ba. Carbonates may also be used to catalyze the formation of polycrystalline diamond.

In some embodiments, the catalyst material 50 may comprise between about 1% and about 5% by volume of the first region 20 of the hard polycrystalline material 16, and may at least substantially occupy a remainder of the volume of the first region 20 of the hard polycrystalline material 16 that is not occupied by the grains 30, 32 of hard material. In the second region 22 of the hard polycrystalline material 16, the voids 42 in the interstitial spaces between the grains 40 may comprise between about 8% and about 20% by volume of the second region 22, and may at least substantially occupy a remainder of the volume of the second region 22 that is not occupied by the grains 40 of hard material.

The interstitial spaces between the grains 30, 32, 40 of hard material primarily comprise an open, interconnected network of spatial regions within the microstructure of the hard polycrystalline material 16. A relatively small portion of the interstitial spaces may comprise closed, isolated spatial regions within the microstructure. It is noted that the first region 20 may comprise more of such closed, isolated spatial regions than does the second region 22. When it is said that the interstitial spaces between the inter-bonded grains 40 of hard material in the second region 22 are at least substantially free of such catalyst material, it is meant that catalyst material is removed from the open, interconnected network of spatial regions between the grains 40 within the microstructure, although a relatively small amount of catalyst material may remain in closed, isolated spatial regions between the grains 40, as a leaching agent may not be able to reach volumes of catalyst material within such closed, isolated spatial regions.

In some embodiments, the mean free path within the interstitial spaces between the inter-bonded grains 30, 32 in the first region 20 of the hard polycrystalline material 16 may be less than the mean free path within the interstitial spaces between the inter-bonded grains 40 in the second region 22 of the hard polycrystalline material 16. For example, the mean free path within the interstitial spaces between the inter-bonded grains 30, 32 in the first region 20 of the hard polycrystalline material 16 may be about ninety percent (90%) or less, about seventy-five percent (75%) or less, or even about fifty percent (50%) or less, of the mean free path within the interstitial spaces between the inter-bonded grains 40 in the second region 22 of the hard polycrystalline material 16. Theoretically, the mean free path within the interstitial spaces between the inter-bonded grains 30, 32 in the first region 20, and the mean free path within the interstitial spaces between the inter-bonded grains 40 in the second region 22 may be determined using techniques known in the art, such as those set forth in Ervin E. Underwood, Quantitative Stereology, (Addison-Wesley Publishing Company, Inc. 1970), which is incorporated herein in its entirety by this reference.

It is also known in the art that many physical characteristics of hard polycrystalline material, such as polycrystalline diamond, in which a ferromagnetic catalyst material 50 (such as cobalt, iron, or nickel, or an alloy or mixture thereof) may be determined by measuring certain magnetic properties of the hard polycrystalline material. For example, as taught in U.S. Patent Application Publication No. U.S. 2010/0225311, published Sep. 9, 2010 in the name of Bertagnolli et al., now U.S. Pat. No. 8,461,832, issued Jun. 11, 2013, which is incorporated herein in its entirety by this reference, the mean free path between neighboring diamond grains in a body of polycrystalline diamond may be correlated with the measured coercivity of the polycrystalline diamond material. A relatively large coercivity indicates a relatively smaller mean free path within the ferromagnetic domains of catalyst material 50 in the interstitial spaces between the diamond grains. Thus, the mean free path within the interstitial spaces between the inter-bonded grains 30, 32 in the first region 20, and the mean free path within the interstitial spaces between the inter-bonded grains 40 in the second region 22 may be determined by measuring the magnetic coercivity of the first region 20 and the second region 22 using techniques as disclosed in the aforementioned U.S. Patent Application Publication No. U.S. 2010/0225311, with the caveat that the mean free path within the interstitial spaces between the inter-bonded grains 40 in the second region 22 would need to be measured prior to removing catalyst material therefrom, as discussed in further detail hereinbelow. Such techniques may be more practical than the more theoretical approaches set forth in Ervin E. Underwood, Quantitative Stereology, (Addison-Wesley Publishing Company, Inc. 1970). Further, such techniques may be non-destructive, while the approaches set forth in Quantitative Stereology may require destruction of the samples for analysis.

By way of example and not limitation, the first region 20 of the hard polycrystalline material 16 may exhibit a magnetic coercivity of about 110 Oersteds (Oe) or less, and the second region 22 of the hard polycrystalline material 16 may exhibit a magnetic coercivity of about 110 Oersteds (Oe) or more, about 125 Oe or more, or even about 130 Oe or more, prior to removing the catalyst material 50 from the interstitial spaces between the inter-bonded grains 40 in the second region 22, as discussed in further detail below.

In additional embodiments of the invention, nanoparticles or nanograins of hard material (e.g., diamond) may be used in the formation of the first region 20, although the fully formed hard polycrystalline material 16 may not include the smaller grains 32 (e.g., nanograins). Such nanograins may become incorporated into the larger grains 30 during the sintering process used to form the hard polycrystalline material 16. In such embodiments, however, the first region 20 may still have the relatively higher density of hard material, and the interstitial spaces within the first region 20 may be relatively smaller and more dispersed when compared to the second region 22, as described hereinabove.

Referring again to FIGS. 1 and 2, the polycrystalline compact 12 has a generally flat, cylindrical, and disc-shaped configuration. An exposed, planar major surface 26 of the first region 20 of the polycrystalline compact 12 defines a front cutting face of the cutting element 10. One or more lateral side surfaces of the polycrystalline compact 12 extend from the major surface 26 of the polycrystalline compact 12 to the substrate 14 on a lateral side of the cutting element 10. In the embodiment shown in FIGS. 1 and 2, each of the first region 20 and the second region 22 of the hard polycrystalline material 16 comprises a generally planar layer that extends to and is exposed at the lateral side of the polycrystalline compact 12. For example, a lateral side surface of the first region 20 of the hard polycrystalline material 16 may have a generally cylindrical shape, and a lateral side surface of the second region 22 of the hard polycrystalline material 16 may have an angled, frustoconical shape and may define or include a chamfer surface of the cutting element 10.

Figure 5A:
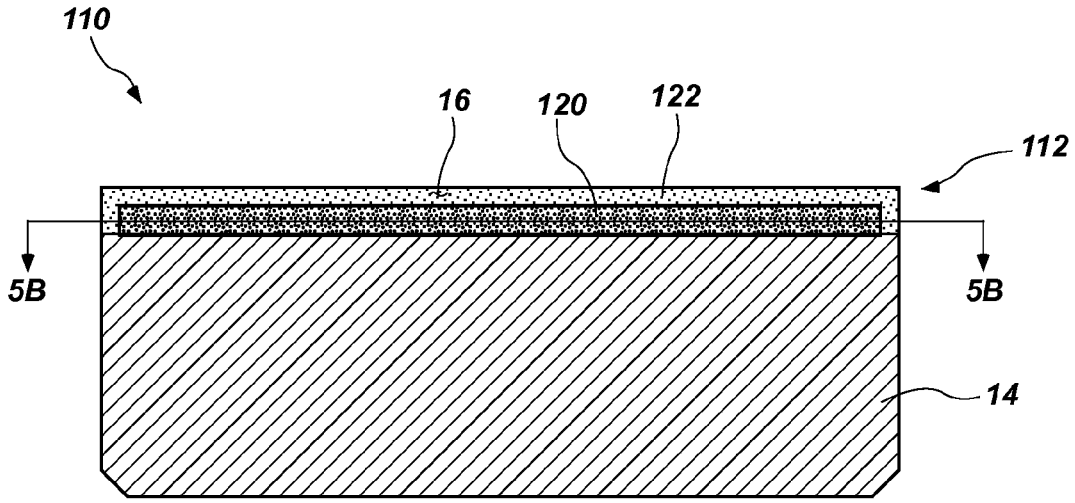
FIG. 5A is a cross-sectional side view like that of FIG. 2 and illustrates another embodiment of a cutting element comprising a polycrystalline compact having two regions with different diamond densities and catalyst contents therein.
Figure 5B:
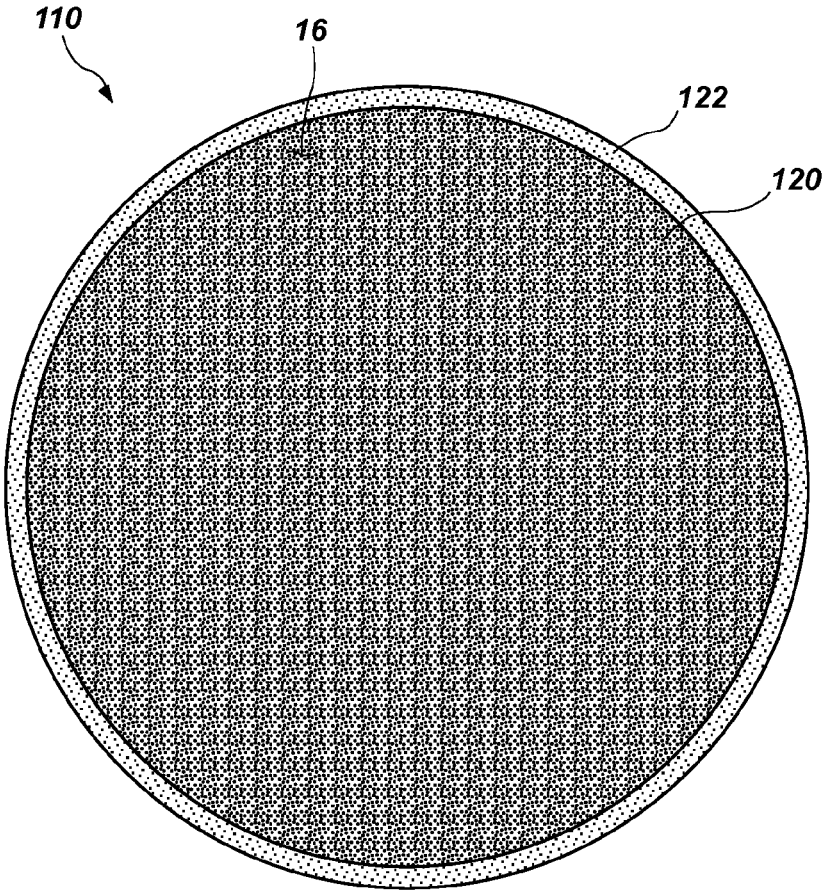
FIG. 5B is a cross-sectional view of the cutting element shown in FIG. 5A taken along the section line 5B-5B shown therein.

Embodiments of cutting elements 10 and polycrystalline compacts 12 of the present invention may have shapes and configurations other than those shown in FIGS. 1 and 2. For example, an additional embodiment of a cutting element 110 of the present invention is shown in FIGS. 5A and 5B. The cutting element 110 is similar to the cutting element 10 in many aspects, and includes a polycrystalline compact 112 that is bonded to a cutting element substrate 14. The polycrystalline compact 112 comprises a table or layer of hard polycrystalline material 16 as previously described that has been provided on (e.g., formed on or secured to) a surface of a supporting cutting element substrate 14. The polycrystalline compact 112 includes a first region 120 and a second region 122, as shown in FIGS. 5A and 5B. The first region 120 and a the second region 122 may have a composition and microstructure as described above in relation to the first region 20 and the second region 22 with reference to FIGS. 1 through 4.

In the embodiment of FIGS. 5A and 5B, however, the first region 120 does not extend to, and is not exposed at, the lateral side of the cutting element 110. The second region 122 extends over the major planar surface of the first region 120 on a side thereof opposite the substrate 14, and also extends over and around the lateral side surface of the first region 120 to the substrate 14. In this configuration, a portion of the second region 122 has an annular shape that extends circumferentially around a cylindrically shaped lateral side surface of the first region 120. It is contemplated that the first region 120 and the second region 122 may have various different shapes and configurations, and one or more portions of the second region 122 may extend through or past the first region 120 to a substrate 14 in a number of different configurations.

Figure 6A:
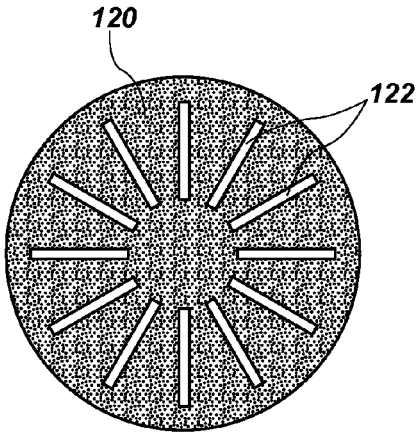
FIGS. 6A through 6F are cross-sectional views like that of FIG. 5B and illustrate various different embodiments of cutting elements of the invention that include two regions with different diamond densities and catalyst contents therein.
Figure 6B:
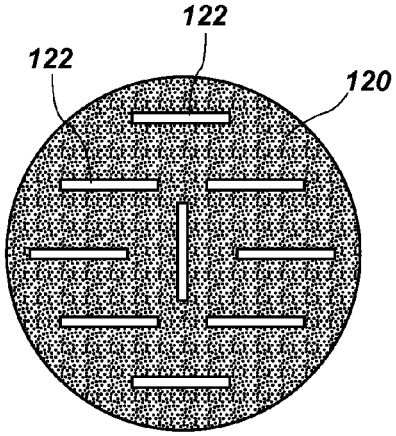
Figure 6C:
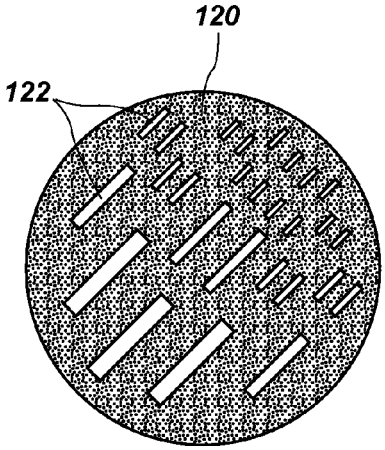
Figure 6D:
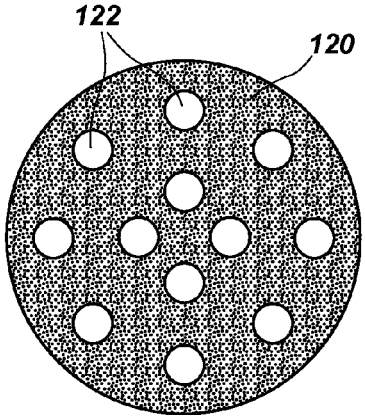
Figure 6E:
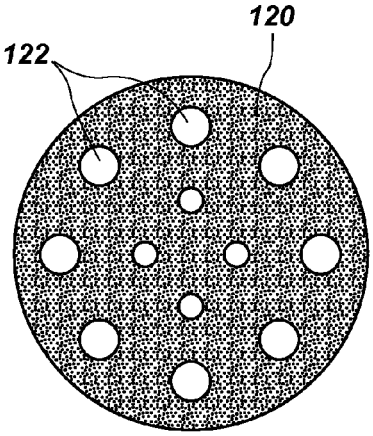
Figure 6F:
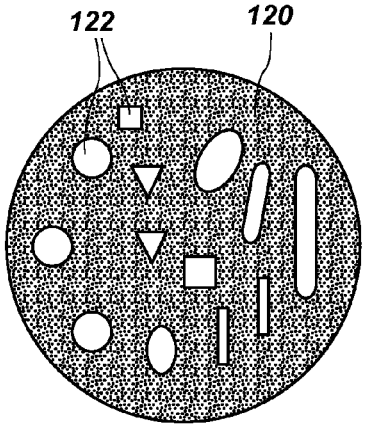

FIGS. 6A through 6F are cross-section views like that of FIG. 5B, and illustrate a number of different configurations that may be exhibited by the first region 120 and the second region 122. As shown in FIG. 6A, elongated, generally straight portions of the second region 122 may be disposed within the first region 120, and may be radially oriented in a spoke-like configuration within the first region 120. In other words, the elongated, generally straight portions of the second region 122 may extend from locations proximate a center of the first region 120 radially outward toward a lateral side surface of the first region 120, as shown in FIG. 6A. As shown in FIG. 6B, the elongated, generally straight portions of the second region 122 may be disposed in other orientations (e.g., random or ordered orientations) within the first region 120. The elongated, generally straight portions of the second region 122 shown in FIGS. 6A and 6B are of uniform size. In additional embodiments, the elongated, generally straight portions of the second region 122 may have differing sizes, which may gradually change across the first region 120 from one side toward another opposite side thereof, as shown in FIG. 6C. FIG. 6D illustrates an embodiment in which portions of the second region 122 that extend through the first region 120 have a circular cross-sectional shape, a uniform size, and are located in an ordered array within the first region 120. FIG. 6E illustrates an embodiment in which portions of the second region 122 that extend through the first region 120 have a circular cross-sectional shape, a non-uniform size, and are located in an ordered array within the first region 120. FIG. 6F illustrates an embodiment in which portions of the second region 122 that extend through the first region 120 have differing shapes, differing sizes, and are randomly located within the first region 120.

Additional embodiments of the invention include methods of manufacturing polycrystalline compacts and cutting elements, such as the polycrystalline compacts and cutting elements described hereinabove. In general, the methods include forming an unsintered compact by mixing a first plurality of grains of hard material having a first average grain size with a second plurality of grains of hard material having a second average grain size smaller than the first average grain size to form a first particulate mixture, and positioning a third plurality of grains of hard material having a third average grain size adjacent the first particulate mixture within a container. The unsintered compact then may be sintered in the presence of a catalyst material, as described herein, to form a hard polycrystalline material having a first region comprising inter-bonded grains of the first plurality of grains of hard material and the second plurality of grains of hard material, and a second region comprising inter-bonded grains of the third plurality of grains of hard material. In some embodiments, the sintering process may comprise a high temperature/high pressure (HTHP) sintering process. For example, the sintering process may be carried out at a pressure greater than about five gigapascals (5.0 GPa) and a temperature greater than about 1,300° C. In some embodiments, the sintering process may be carried out at a pressure below about six gigapascals (6.0 GPa). In other embodiments, the sintering process may be carried out at a pressure greater than about six and one-half gigapascals (6.5 GPa). Catalyst material then may be removed from interstitial spaces within the second region of the hard polycrystalline material without entirely removing catalyst material from interstitial spaces within the first region of the hard polycrystalline material.

Figure 7:
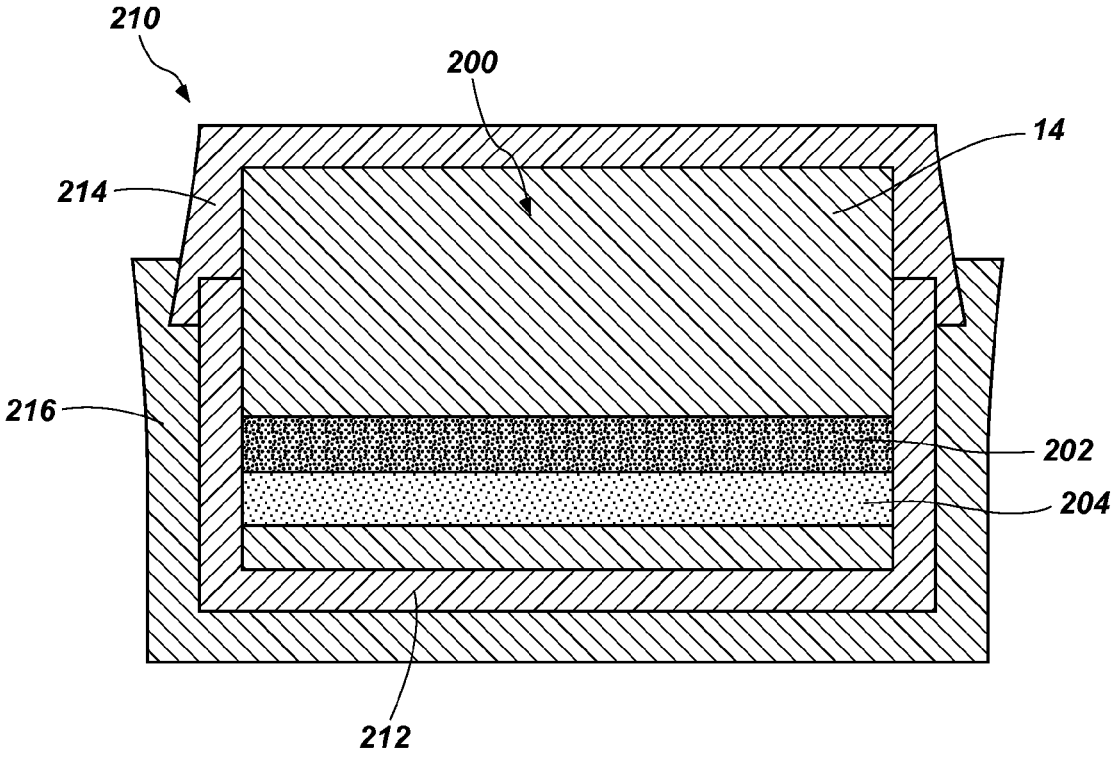
FIG. 7 is a simplified cross-sectional view of an assembly that may be employed in embodiments of methods of the invention, which may be used to fabricate cutting elements as described herein, such as the cutting element shown in FIGS. 1 and 2.

FIG. 7 illustrates an unsintered compact preform 200 within a container 210 prior to a sintering process. The unsintered compact preform 200 is provided with a first volume of particulate matter 202 and a second volume of particulate matter 204. The unsintered compact preform 200 optionally may be further provided with a cutting element substrate 14, as shown in FIG. 7. The first volume of particulate matter 202 is used to form the first region 20 of the hard polycrystalline material 16 of the polycrystalline compact 12 of FIGS. 1 and 2, and the second volume of particulate matter 204 is used to form the second region 22 of the hard polycrystalline material 16 of the polycrystalline compact 12.

The container 210 may include one or more generally cup-shaped members, such as the cup-shaped member 212, the cup-shaped member 214, and the cup-shaped member 216, which may be assembled and swaged and/or welded together to form the container 210. The first volume of particulate matter 202, the second volume of particulate matter 204, and the optional cutting element substrate 14 may be disposed within the inner cup-shaped member 212, as shown in FIG. 7, which has a circular end wall and a generally cylindrical lateral side wall extending perpendicularly from the circular end wall, such that the inner cup-shaped member 212 is generally cylindrical and includes a first closed end and a second, opposite open end.

The first volume of particulate matter 202 may be provided adjacent a surface of a substrate 14, and the second volume of particulate matter 204 may be provided on a side of the first volume of particulate matter 202 opposite the substrate 14.

At least the first volume of particulate matter 202 and the second volume of particulate matter 204 include crystals or grains of hard material, such as diamond. To catalyze the formation of inter-granular bonds between the diamond grains in the first volume of particulate matter 202 and between the diamond grains in the second volume of particulate matter 204 during an HTHP sintering process, the diamond grains in the first volume of particulate matter 202 and the second volume of particulate matter 204 may be physically exposed to catalyst material during the sintering process. In other words, particles of catalyst material may be provided in one or both of the first volume of particulate matter 202 and the second volume of particulate matter 204 prior to commencing the HTHP process, or catalyst material may be allowed or caused to migrate into each of the first volume of particulate matter 202 and the second volume of particulate matter 204 from one or more sources of catalyst material during the HTHP process. For example, the first volume of particulate matter 202 optionally may include particles comprising a catalyst material (such as, for example, particles of cobalt, iron, nickel, or an alloy and mixture thereof). If the substrate 14 includes a catalyst material, however, the catalyst material may be swept from the surface of the substrate 14 into the first volume of particulate matter 202 during sintering, and catalyze the formation inter-granular diamond bonds between the diamond grains in the first volume of particulate matter 202. In such instances, it may not be necessary or desirable to include particles of catalyst material in the first volume of particulate matter 202.

The second volume of particulate matter 204 also, optionally, may further include particles of catalyst material. In some embodiments, however, a catalyst structure that includes a catalyst material may be provided on a side of the second volume of particulate matter 204 opposite the first volume of particulate matter 202 during sintering. The catalyst structure may comprise a solid cylinder or disc that includes catalyst material, and may have a material composition similar to the substrate 14. In such embodiments, catalyst material may be swept from the catalyst structure into the second volume of particulate matter 204 during sintering and catalyze the formation of inter-granular diamond bonds between the diamond grains in the second volume of particulate matter 204. In such instances, it may not be necessary or desirable to include particles of catalyst material in the second volume of particulate matter 204.

In some embodiments, particles of catalyst material may be provided within the second volume of particulate matter 204, but not in the first volume of particulate matter 202, and catalyst material may be swept into the first volume of particulate matter 202 from the substrate 14. It may be desirable to incorporate particles of catalyst material into the second volume of particulate matter 204, as the rate of flow of molten catalyst material through the first volume of particulate matter 202 during the sintering process may be relatively low due to the increased density of the hard material, and the relatively small and dispersed interstitial spaces between the grains of hard material within the first volume of particulate matter 202 through which the catalyst material flows.

In some embodiments, particles of catalyst material that are incorporated into either the first volume of particulate matter 202 or the second volume of particulate matter 204 may have an average particle size of between about ten nanometers (10 nm) and about one micron (1 μm). Further, it may be desirable to select the average particle size of the catalyst particles such that a ratio of the average particle size of the catalyst particles to the average grain size of the grains of hard material with which the particles are mixed is within the range of from about 1:10 to about 1:1000, or even within the range from about 1:100 to about 1:1000, as disclosed in U.S. Patent Application Publication No. US 2010/0186304 A1, which published Jul. 29, 2010 in the name of Burgess et al., now U.S. Pat. No. 8,435,317, issued May 7, 2013, and is incorporated herein in its entirety by this reference. Particles of catalyst material may be mixed with the grains of hard material using techniques known in the art, such as standard milling techniques, sol-gel techniques, by forming and mixing a slurry that includes the particles of catalyst material and the grains of hard material in a liquid solvent, and subsequently drying the slurry, etc.

The diamond grains in the first volume of particulate matter 202 have a multi-modal (e.g., bi-modal, tri-modal, etc.) grain size distribution. For example, the diamond grains in the particulate matter may include the first plurality of grains 30 of hard material having a first average grain size, and the second plurality of grains 32 of hard material having a second average grain size that differs from the first average grain size of the first plurality of grains 30, in an unbonded state. The unbounded first plurality of gains 30 and second plurality of grains 32 may have relative and actual sizes as previously described with reference to FIGS. 3 and 4, although it is noted that some degree of grain growth and/or shrinkage may occur during the sintering process used to form the hard polycrystalline material 16. For example, the first plurality of grains 30 may undergo some level of grain growth during the sintering process, and the second plurality of grains 32 may undergo some level of grain shrinkage during the sintering process. In other words, the first plurality of grains 30 may grow at the expense of the second plurality of grains 32 during the sintering process.

The diamond grains in the second volume of particulate matter 204 may have a third average grain size. In some embodiments, the diamond grains in the second volume of particulate matter 204 may have a mono-modal grain size distribution. In other embodiments, however, the diamond grains in the second volume of particulate matter 204 may have a multi-modal (e.g., bi-modal, tri-modal, etc.) grain size distribution. In such embodiments, however, the average grain size of each mode may be greater than about five hundred nanometers (500 nm). In other words, the diamond grains in the second volume of particulate matter 204 may be free of nanoparticles or nanograins of the hard material. The diamond grains in the second volume of particulate matter 204 may include the unbonded plurality of grains 40 of hard material previously described with reference to FIG. 4. The unbounded diamond grains 40 may have relative and actual sizes as previously described with reference to FIGS. 3 and 4, although it is noted that some degree of grain growth and/or shrinkage may occur during the sintering process used to form the hard polycrystalline material 16, as previously mentioned.

After providing the first volume of particulate matter 202, the second volume of particulate matter 204, and the optional substrate 14 within the container 210 as shown in FIG. 7, the assembly optionally may be subjected to a cold pressing process to compact the first volume of particulate matter 202, the second volume of particulate matter 204, and the optional substrate 14 in the container 210.

The resulting assembly then may be sintered in an HTHP process in accordance with procedures known in the art to form a cutting element 10 having polycrystalline compact 12 comprising a hard polycrystalline material 16 including a first region 20 and a second region 22, generally, as previously described with reference to FIGS. 1 and 2. Referring to FIGS. 2 and 7 together, the first volume of particulate matter 202 (FIG. 7) may form a first region 20 of the hard polycrystalline material 16 (FIG. 2), and the second volume of particulate matter 204 (FIG. 7) may form a second region 22 of the hard polycrystalline material 16 (FIG. 2).

Although the exact operating parameters of HTHP processes will vary depending on the particular compositions and quantities of the various materials being sintered, the pressures in the heated press may be greater than about five gigapascals (5.0 GPa) and the temperatures may be greater than about fifteen hundred degrees Celsius (1,500° C.). In some embodiments, the pressures in the heated press may be greater than about 6.5 GPa (e.g., about 6.7 GPa). Furthermore, the materials being sintered may be held at such temperatures and pressures for between about thirty seconds (30 sec) and about twenty minutes (20 min). In embodiments in which a carbonate catalyst material 50 (e.g., a carbonate of one or more of Mg, Ca, Sr, and Ba) is used to catalyze the formation of polycrystalline diamond, the particulate mixture may be subjected to a pressure greater than about 7.7 gigapascals (7.7 GPa) and a temperature greater than about 2,000° C.

Figure 8:
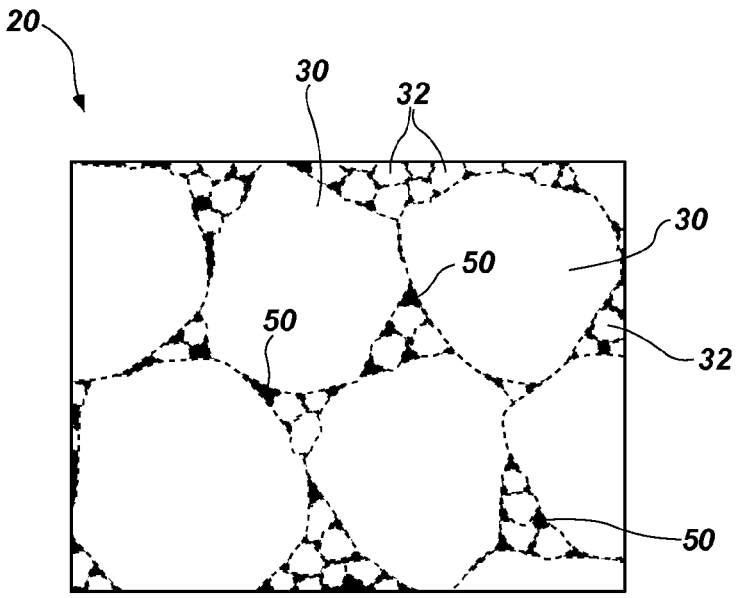
FIGS. 8 and 9 are simplified drawings, like those of FIGS. 3 and 4, respectively, and show how the microstructures of the first and second regions of the polycrystalline compact may appear under magnification after a sintering process used to form the polycrystalline compact and prior to a leaching process used to remove catalyst material from within the second region.
Figure 9:
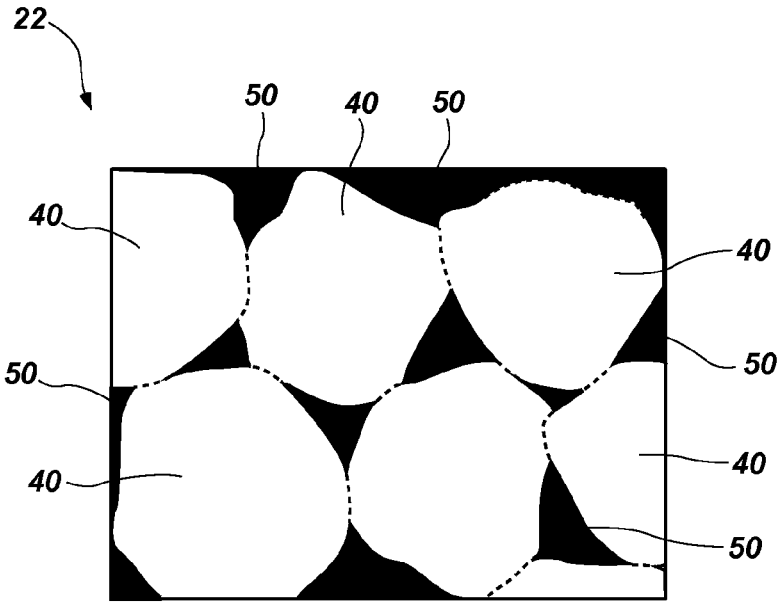

FIGS. 8 and 9 are simplified drawings, like those of FIGS. 3 and 4, respectively, and show how the microstructures of the first region 20 and the second region 22 of the polycrystalline compact 12 may appear under magnification after the sintering process used to form the polycrystalline compact 12. FIG. 8 is identical to FIG. 3, and the microstructure of the first region 20 after sintering (FIG. 8) may be the same as that in the final cutting element 10 (FIG. 3). As previously described herein, however, in additional embodiments of the invention, although nanoparticles or nanograins of hard material (e.g., diamond) may be used in the formation of the first region 20, the fully formed hard polycrystalline material 16 may not include the smaller grains 32 (e.g., nanograins), as such nanograins may become incorporated into the larger grains 30 during the sintering process used to form the hard polycrystalline material 16.

As shown in FIG. 9, catalyst material 50 (shaded black in FIG. 3), for catalyzing the formation of inter-granular bonds between the grains 40 of the hard polycrystalline material 16, may be present within the interstitial spaces between the inter-bonded grains 40 of the hard polycrystalline material 16 in the second region 22 after the sintering process.

Thus, after the sintering process, catalyst material 50 in the interstitial spaces between the diamond grains 40 in the second region 22 of the hard polycrystalline material 16 in the polycrystalline compact 12 may be removed from between the diamond grains 40 using, for example, an acid leaching process. Specifically, as known in the art and described more fully in U.S. Pat. Nos. 5,127,923 and 4,224,380, which are incorporated herein in their entirety by this reference, aqua regia (a mixture of concentrated nitric acid ($HNO_3$) and concentrated hydrochloric acid (HCl)) may be used to at least substantially remove catalyst material 50 from the interstitial spaces between the diamond grains 40 in the second region 22 of the polycrystalline compact 12. It is also known to use boiling hydrochloric acid (HCl) and boiling hydrofluoric acid (HF) as leaching agents. One particularly suitable leaching agent is hydrochloric acid (HCl) at a temperature of above 110° C., which may be provided in contact with exposed surfaces of the second region 22 of the hard polycrystalline material 16 for a period of about 2 hours to about 60 hours, depending upon the size of the body comprising the hard polycrystalline material 16. Surfaces of the cutting element 10 other than those to be leached, such as surfaces of the substrate 14, and/or exposed lateral surfaces of the first region 20 of the hard polycrystalline material 16, may be covered (e.g., coated) with a protective material, such as a polymer material, that is resistant to etching or other damage from the leaching agent. The surfaces to be leached then may be exposed to and brought into contact with the leaching fluid by, for example, dipping or immersing at least a portion of the second region 22 of the polycrystalline compact 12 of the cutting element 10 into the leaching fluid.

The leaching fluid will penetrate into the second region 22 of the polycrystalline compact 12 of the cutting element 10 from the exposed surfaces thereof. The depth or distances into the second region 22 of the polycrystalline compact from the exposed surfaces reached by the leaching fluid will be a function of the time to which the second region 22 is exposed to the leaching fluid (i.e., the leaching time). The rate of flow of the leaching fluid through the first region 20 of the polycrystalline compact 12 during the leaching process may be relatively lower than the flow rate through the second region 22 due to the increased density of the hard material in the first region 20, and the relatively small and dispersed interstitial spaces between the grains 30, 32 of hard material within the first region 20 through which the leaching fluid must flow. In other words, the interface 24 may serve as a barrier to hinder or impede the flow of leaching fluid further into the hard polycrystalline material 16, and specifically, into the first region 20 of the hard polycrystalline material 16. As a result, once the leaching fluid reaches the interface 24 (FIGS. 1 and 2) between the first region 20 and the second region 22, the rate at which the leaching depth increases as a function of time may be reduced. Thus, a specific desirable depth at which it is desired to leach catalyst material 50 from the polycrystalline material 16 may be selected and defined by positioning the interface 24 between the first region 20 and the second region 22 at a desirable, selected depth or location within the hard polycrystalline material 16. The interface 24 may be used to hinder or impede the flow of leaching fluid, and, hence, leaching of catalyst material 50 out from the hard polycrystalline material 16, beyond a desirable, selected leaching depth, at which the interface 24 is positioned. Stated another way, the flow of the leaching fluid through the first region 20 of the hard polycrystalline material 16 between the grains 30, 32 may be impeded using the smaller grains 32 of hard material in the first region 20 of the hard polycrystalline material 16 as a barrier to the leaching fluid.

Once the leaching fluid reaches the interface 24, continued exposure to the leaching fluid may cause further leaching of catalyst material 50 out from the first region 20 of the hard polycrystalline material 16, although at a slower leaching rate than that at which catalyst material 50 is leached out from the second region 22 of the hard polycrystalline material 16. Such leaching of catalyst material 50 out from the first region 20 may be undesirable, and the duration of the leaching process may be selected such that catalyst material 50 is not leached out from the first region 20 in any significant quantity (i.e., in any quantity that would measurably alter the abrasiveness or fracture toughness of the polycrystalline compact 12).

Thus, catalyst material 50 may be leached out from the interstitial spaces within the second region 22 of the hard polycrystalline material 16 using a leaching fluid without entirely removing catalyst material 50 from the interstitial spaces within the first region 20 of the hard polycrystalline material 16. In some embodiments, the catalyst material 50 may remain within at least substantially all (e.g., within about 98% by volume or more) of the interstitial spaces within the first region 20 of the hard polycrystalline material 16.

After leaching the second region 22 of the hard polycrystalline material 16, the interstitial spaces between the inter-bonded grains 40 of hard material within the second region 22 of the hard polycrystalline material 16 may be at least substantially free of the catalyst material 50. Thus, the interstitial spaces between the inter-bonded grains 40 of hard material in the second region 22 may comprise voids 42, as previously described with reference to FIG. 4.

Figure 10:
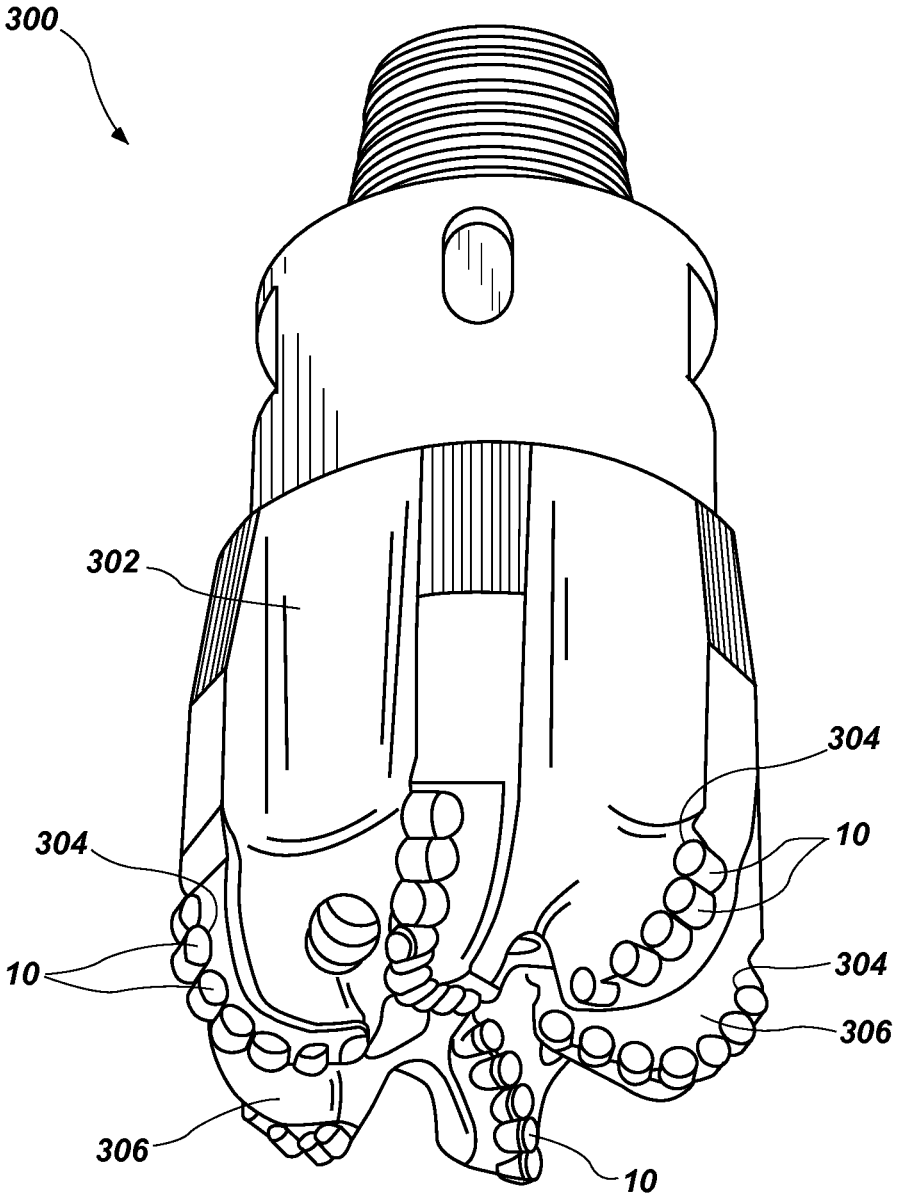
FIG. 10 is a perspective view of an embodiment of a fixed-cutter earth-boring rotary drill bit that includes a plurality of polycrystalline compacts like that shown in FIGS. 1 and 2.

Embodiments of polycrystalline compacts and cutting elements of the invention, such as the cutting elements 10 and polycrystalline compacts 12, described above with reference to FIGS. 1 through 4, may be formed and secured to earth-boring tools for use in forming wellbores in subterranean formations. As a non-limiting example, FIG. 10 illustrates a fixed cutter type earth-boring rotary drill bit 300, which includes a plurality of cutting elements 10 as previously described herein. The rotary drill bit 300 includes a bit body 302, and the cutting elements 10 are bonded to the bit body 302. The cutting elements 10 may be brazed (or otherwise secured) within pockets 304 formed in the outer surface of each of a plurality of blades 306 of the bit body 302.

Cutting elements and polycrystalline compacts as described herein may be bonded to and used on other types of earth-boring tools, including, for example, roller cone drill bits, percussion bits, core bits, eccentric bits, bicenter bits, reamers, expandable reamers, mills, hybrid bits, and other drilling bits and tools known in the art.

The foregoing description is directed to particular embodiments for the purpose of illustration and explanation. It will be apparent, however, to one skilled in the art that many modifications and changes to the embodiments set forth above are possible without departing from the scope of the embodiments disclosed herein as hereinafter claimed, including legal equivalents. It is intended that the following claims be interpreted to embrace all such modifications and changes.

What is claimed is:

1. A polycrystalline compact, comprising:
- a hard polycrystalline material comprising:
  - a first region adjacent a substrate and comprising:
    - inter-bonded grains of hard material comprising:
      - a first plurality of grains exhibiting a first average grain size; and
      - a second plurality of grains exhibiting a second average grain size smaller than the first average grain size; and
    - interstitial spaces between the inter-bonded grains of hard material, the interstitial spaces at least partially filled with catalyst material; and
  - a second region directly adjacent to the first region and comprising:
    - additional inter-bonded grains of the hard material, the second region having a smaller volume percentage of the hard material than a volume percentage of the hard material of the first region; and
    - additional interstitial spaces between the additional inter-bonded grains of the hard material, the additional interstitial spaces at least substantially free of the catalyst material.

2. The polycrystalline compact of claim 1, wherein the additional inter-bonded grains of the hard material comprise a third plurality of grains exhibiting the first average grain size.

3. The polycrystalline compact of claim 1, wherein the first region comprises between about 92 percent by volume and about 99 percent by volume of the inter-bonded grains of the hard material.

4. The polycrystalline compact of claim 3, wherein the second region comprises between about 80 percent by volume and about 91 percent by volume of the additional inter-bonded grains of the hard material.

5. The polycrystalline compact of claim 1, wherein the second region comprises:
- a portion extending over a surface of the first region opposite the substrate; and
- another portion extending circumferentially around a cylindrically shaped lateral side surface of the first region.

6. The polycrystalline compact of claim 1, wherein the interstitial spaces of the first region are at least substantially filled with catalyst material.

7. The polycrystalline compact of claim 1, wherein the additional interstitial spaces of the second region are at least substantially filled with gas.

8. The polycrystalline compact of claim 1, wherein the interstitial spaces of the first region are more dispersed than the additional interstitial spaces of the second region.

9. The polycrystalline compact of claim 1, wherein the hard polycrystalline material is attached to the substrate.

10. An earth-boring tool, comprising:
- a tool body; and
- at least one cutting element attached to the tool body and comprising:
  - a polycrystalline compact comprising:
    - a hard polycrystalline material, comprising:
    - a first region adjacent the substrate and comprising:
    - inter-bonded grains of hard material comprising:
      - a first plurality of grains exhibiting a first average grain size; and
      - a second plurality of grains exhibiting a second average grain size smaller than the first average grain size; and
      - interstitial spaces between the inter-bonded grains of hard material, the interstitial spaces at least partially filled with catalyst material; and
  - a second region directly adjacent to the first region and comprising:
    - additional inter-bonded grains of the hard material, the second region having a smaller volume percentage of the hard material than a volume percentage of the hard material of the first region; and
    - additional interstitial spaces between the additional inter-bonded grains of the hard material, the additional interstitial spaces at least substantially free of catalyst material.

11. A method of forming a cutting element, comprising:
forming a polycrystalline compact, comprising:
a first region adjacent a substrate and comprising:
inter-bonded grains of hard material comprising:
a first plurality of grains exhibiting a first average grain size; and
a second plurality of grains exhibiting a second average grain size smaller than the first average grain size; and
interstitial spaces between the inter-bonded grains of the hard material; and
a second region directly adjacent to the first region and comprising:
additional inter-bonded grains of the hard material, the second region having a smaller volume percentage of the hard material than a volume percentage of the hard material of the first region; and
additional interstitial spaces between the additional inter-bonded grains of the hard material; and
attaching the polycrystalline compact to the substrate.

12. The method of claim 11, wherein forming the polycrystalline compact comprises:
forming a particulate mixture comprising the first plurality of grains of the hard material and the second plurality of grains of the hard material:
positioning a third plurality of grains of the hard material adjacent the particulate mixture to form a compact preform, the third plurality of grains of the hard material having an average grain size larger than the average grain size of the second plurality of grains of the hard material; and
sintering the compact preform in the presence of catalyst material.

13. The method of claim 12, further comprising selecting the average grain size of the third plurality of grains of the hard material to be substantially the same as the average grain size of the first plurality of grains of the hard material.

14. The method of claim 11, wherein attaching the polycrystalline compact to the substrate comprises substantially simultaneously forming the polycrystalline compact and attaching the polycrystalline compact to the substrate.

15. The method of claim 11, wherein attaching the polycrystalline compact to the substrate comprises attaching the polycrystalline compact to the substrate after forming the polycrystalline compact.

16. The method of claim 11, wherein attaching the polycrystalline compact to the substrate comprises sintering the polycrystalline compact in the presence of the substrate to diffuse catalyst material from the substrate into at least the interstitial spaces of the first region.

17. The method of claim 11, further comprising subjecting the polycrystalline compact to at least one leaching process to substantially remove catalyst material from the additional interstitial spaces of the second region while substantially retaining the catalyst material in the interstitial spaces of the first region.

18. The method of claim 17, wherein subjecting the polycrystalline compact to at least one leaching process comprises leaching the catalyst material from the additional interstitial spaces of the second region before attaching the polycrystalline compact to the substrate.

19. The method of claim 17, wherein subjecting the polycrystalline compact to at least one leaching process comprises leaching the catalyst material from the additional interstitial spaces of the second region after attaching the polycrystalline compact to the substrate.

* * * * *